US005752295A

United States Patent [19]

Musha et al.

[11] Patent Number: 5,752,295

[45] Date of Patent: May 19, 1998

[54] 1 F BLENDED YARN SPINNING METHOD AND BLENDED YARN SPINNING FRAME

[75] Inventors: Toshimitsu Musha, 13-17, Minami-Tsukushino 2-chome, Machida-shi, Tokyo; Yuichi Yanai, Okazaki; Kazuyoshi Muraoka, Osaka; Yuki Niwa, Okazaki, all of Japan

[73] Assignees: Nisshinbo Industries Inc.; Toshimitsu Musha, both of Tokyo, Japan

[21] Appl. No.: 674,718

[22] Filed: Jul. 2, 1996

[30] Foreign Application Priority Data

Jul. 18, 1995 [JP] Japan ..... 7-203806

[51] Int. Cl.[6] ..... D01H 5/00; D01H 7/00

[52] U.S. Cl. ..... 19/236; 19/145.5; 57/315; 57/90

[58] Field of Search ..... 19/236, 243, 145.5, 19/150, 157; 57/315, 90

[56] References Cited

U.S. PATENT DOCUMENTS

| | | | |
|---|---|---|---|
| 2,728,112 | 12/1955 | Berker | 57/315 |
| 2,896,269 | 7/1959 | Gardella et al. | 19/243 |
| 3,327,356 | 6/1967 | Andreani | 19/243 |
| 3,447,206 | 6/1969 | Klein et al. | 19/243 |
| 3,664,115 | 5/1972 | Watson | 57/315 |
| 3,918,127 | 11/1975 | Amsler | 19/243 |
| 4,130,984 | 12/1978 | Lambert, Jr. | 57/315 |
| 4,495,560 | 1/1985 | Sugimoto et al. | 364/154 |
| 5,022,123 | 6/1991 | Ueda et al. | 19/236 |
| 5,161,284 | 11/1992 | Leifeld | 19/243 |
| 5,535,481 | 7/1996 | Hartmeier et al. | 19/236 |

FOREIGN PATENT DOCUMENTS

| | | |
|---|---|---|
| 0670381 A1 | 3/1995 | European Pat. Off. . |
| 4103525 A1 | 2/1991 | Germany . |

OTHER PUBLICATIONS

Japan Abstract JP2074632, Appln. No. JP880226823, Published Mar. 14, 1990, Appln. Date: Sep. 8, 1988 Inventor: Yamada Toyoaki, Title: Production of Composite Yarn.

Japan Abstract JP63099330, Appln. No. JP860246406, Published Apr. 30, 1988, Appln. Date: Oct. 15, 1986, Inventor: Nakagawa Tadao, Title: Fiber Blending Device For Fiber Raw Material.

*Primary Examiner*—Michael A. Neas

*Attorney, Agent, or Firm*—Nikaido, Marmelstein, Murray & Oram LLP

[57] ABSTRACT

In the blending and spinning processes, 1/f fluctuation signals are imparted to the feed slivers or rovings, wherein the blending ratio of the blended slivers, blended rovings, or blended yarn varies with a correlation, specifically a correlation with a 1/f fluctuation.

2 Claims, 3 Drawing Sheets

1 F BLENDED YARN SPINNING METHOD AND BLENDED YARN SPINNING FRAME

BACKGROUND TO INVENTION

This invention relates to blended yarn in which the ratio by which the different types of yarn are blended varies with a predetermined correlation, specifically a correlation with a 1/f fluctuation.

In conventional spinning of blended yarn, different types of fibers are mixed to produce a yarn which combines the properties of each type of yarn. This is achieved by either of two spinning methods; a blending method in which different types of fibers are blended in a certain ratio of fiber lots; or a sliver drawing method in which slivers are combined in a fixed ratio during the drawing of different types of fibers which have been spun by individual routes.

In conventional blended yarn spinning, whether by the blending method or sliver drawing method, different yarns are mixed in a fixed ratio, the blended yarn has an artificial feel of total uniformity with no variation. With very little natural handling, the blended yarn does not impart a comfortable feel.

SUMMARY AND OBJECT OF THE INVENTION

The present inventor, Toshimitsu Musha, was the first in the world to discover that a 1/f fluctuation imparts a particularly comfortable feel to humans. The results were published in "The World of Fluctuations", released by Kodansha Publishers in 1980; and were also announced in a paper entitled "Bioinformation and 1/f Fluctuation", Applied Physics, 1985, pp. 429–435, and another paper entitled "Biocontrol and 1/f Fluctuation", Journal of Japan. Soc. of Precision Machinery, 1984, Vol. 50, No. 6, as well as in a recent publication called "the Concept of Fluctuations", published by NHK in 1994. The abstract of these publications read, > The 1/f Fluctuation provides a comfortable feeling to humans; the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefor a 1/f fluctuation is a fluctuation of the right proportion between these two extremes.

An excerpt from "The World of Fluctuations", published by Kodansha Publishers, reads > For example, the rhythms exhibited by the human body such as hear beats, hand-clapping to music, impulse-release period of neurons, and α-rhythms observed in the brain, are all basically 1/f fluctuations, and it has been shown experimentally that if a body is stimulated by a fluctuation like these biorhythmic 1/f fluctuations, it would feel comfortable. Fluctuations (variations) exist in various forms throughout nature, but the murmur of a brook, a breath of wind, and other phenomena that impart a comfortable feeling to humans have a 1/f fluctuation, while typhoons and other strong winds that impart uneasiness do not have a 1/f fluctuation.

The present invention is designed to overcome these above noted past problems with conventional blended yarn spinning by using the soothing effects of 1/f fluctuations discovered by the present inventor, Toshimitsu Musha.

The objectives of the present invention are as follows:

1. To provide a blended yarn which imparts a natural, comfortable feel to the wearer.

2. To provide a blended yarn with a natural, comfortable feel which can be manufactured on an industrial scale, for which the ratio by which the different types of yarn are blended does not vary randomly but instead varies with a correlation, specifically a correlation with a 1/f fluctuation.

In this invention, "1/f fluctuation" is defined as a power spectrum having a frequency component f, which is proportional to $1/f^k$, where k is approximately 1, and similar spectra thereof.

This present invention comprises a novel blended yarn spinning method in which a number of different types of fibers are mixed by imparting a 1/f fluctuation to the blending ratio of the different fibers.

This invention also provides a novel blended yarn spinning frame for spinning a number of different fibers which comprises a separate feed unit for each different type of fiber bundle; wherein at each feed unit the amount of fiber bundles being fed is varied in accordance with a 1/f fluctuation, then the different types of fiber bundles are mixed and spun together such that the blending ratio of the different types of fiber bundles varies with a 1/f fluctuation.

Moreover, this invention provides a novel blended yarn spinning frame for spinning a number of different fibers which comprises a separate means for drafting each different type of fiber bundle; wherein the rotational speed of the feed rollers of each drafting means is varied in accordance with a 1/f fluctuation, and the different types of fiber bundles are mixed and spun together such that the ultimate fiber bundle produced is of uniform thickness, but its blending ratio varies with a 1/f fluctuation.

This invention provides the following advantages:

1. The blending slivers or mixed rovings ultimately form a blended yarn in which the blending ratio does not vary randomly, rather it varies with a correlation, specifically a correlation with a 1/f fluctuation. The yarn therefore has a natural irregularity which provides a special aesthetic beauty and comfortable wear.
2. Woven fabrics or knitted fabrics made from a blended yarn in which the blending ratio varies with a 1/f fluctuation will also have a 1/f fluctuation. Such products have a special feel and color density after dyeing that varies with a 1/f fluctuation, and provides a special aesthetic beauty and comfortable wear.
3. Woven fabrics with a natural irregular feel of hand-spun yarn can be spun on an industrial scale, at low cost.
4. A sound melody, or a breath of wind whose intensity varies with a 1/f fluctuation can be expressed and incorporated into yarn, which will impart a comfortable wear.

SIMPLIFIED EXPLANATION OF THE DRAWINGS

The above and other objects and the attendant advantages of the present invention will become readily apparent by reference to the following detailed description when considered in conjunction with the accompanying drawings wherein.

Figure 3:
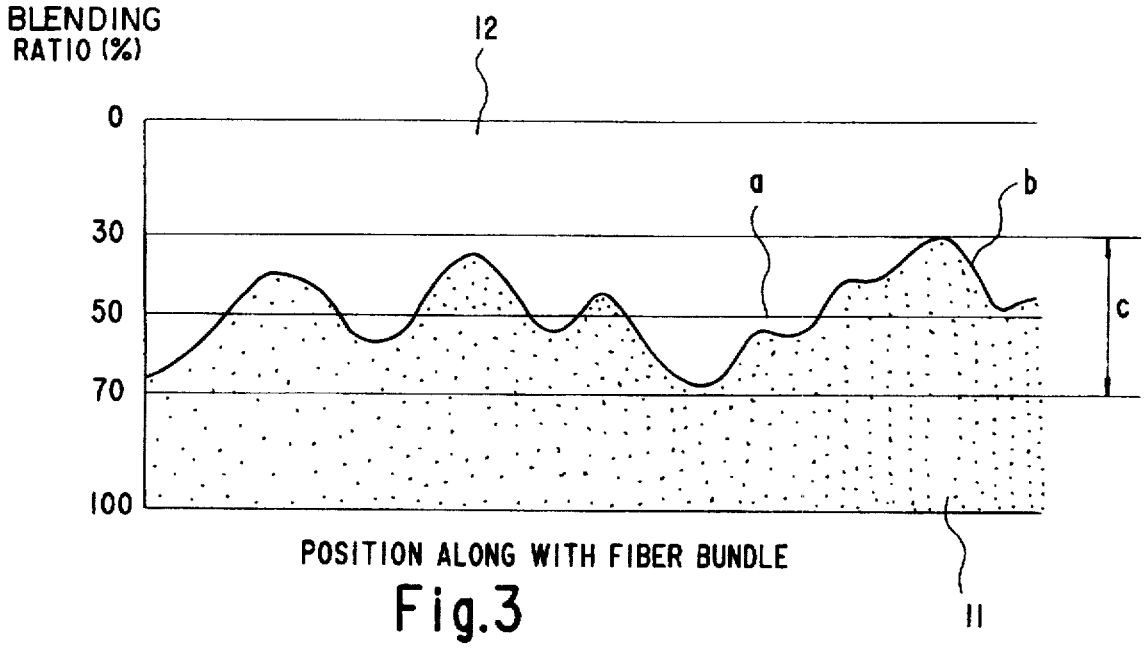
Figure 4:
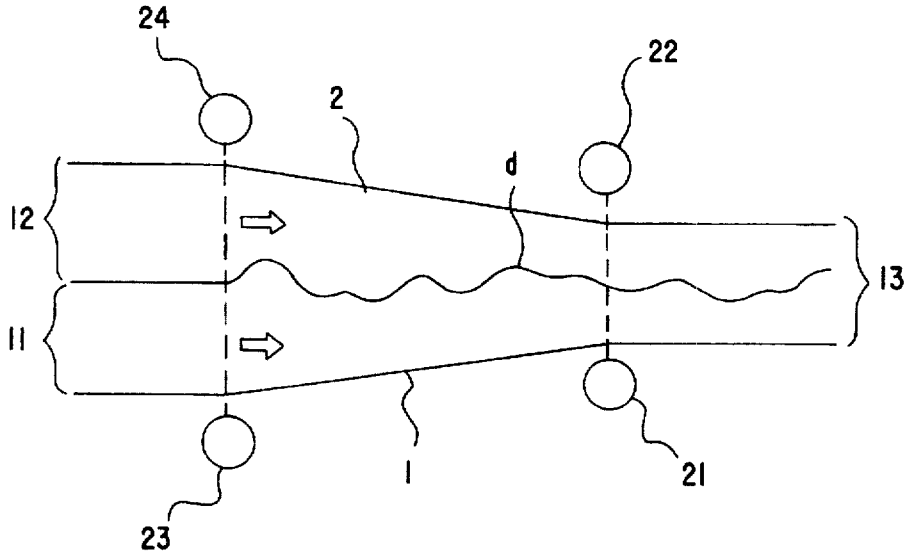

FIG. 3 explains the formation of blended slivers in which the ratio of the blended fibers will vary with a 1/f fluctuation; and FIG. 4 illustrates the drafting process in which the blending ratio varies with a 1/f fluctuation.

DETAILED DESCRIPTION OF THE INVENTION AND OF THE PREFERRED EMBODIMENT

This invention are explained below, with reference to the diagrams.

1. Overview of manufacture of blended yarn A drawing frame, roving frame, spinning frame or other equivalent frames may be used in the manufacture of blended yarn. Fiber bundles used in these frames are formed from short fibers or filaments of natural fibers, regenerated cellulose fibers, or synthetic fibers, or mixtures thereof. Slivers are used for a drawing frame or roving frame, while rovings are used for a spinning frame.

Figure 1:
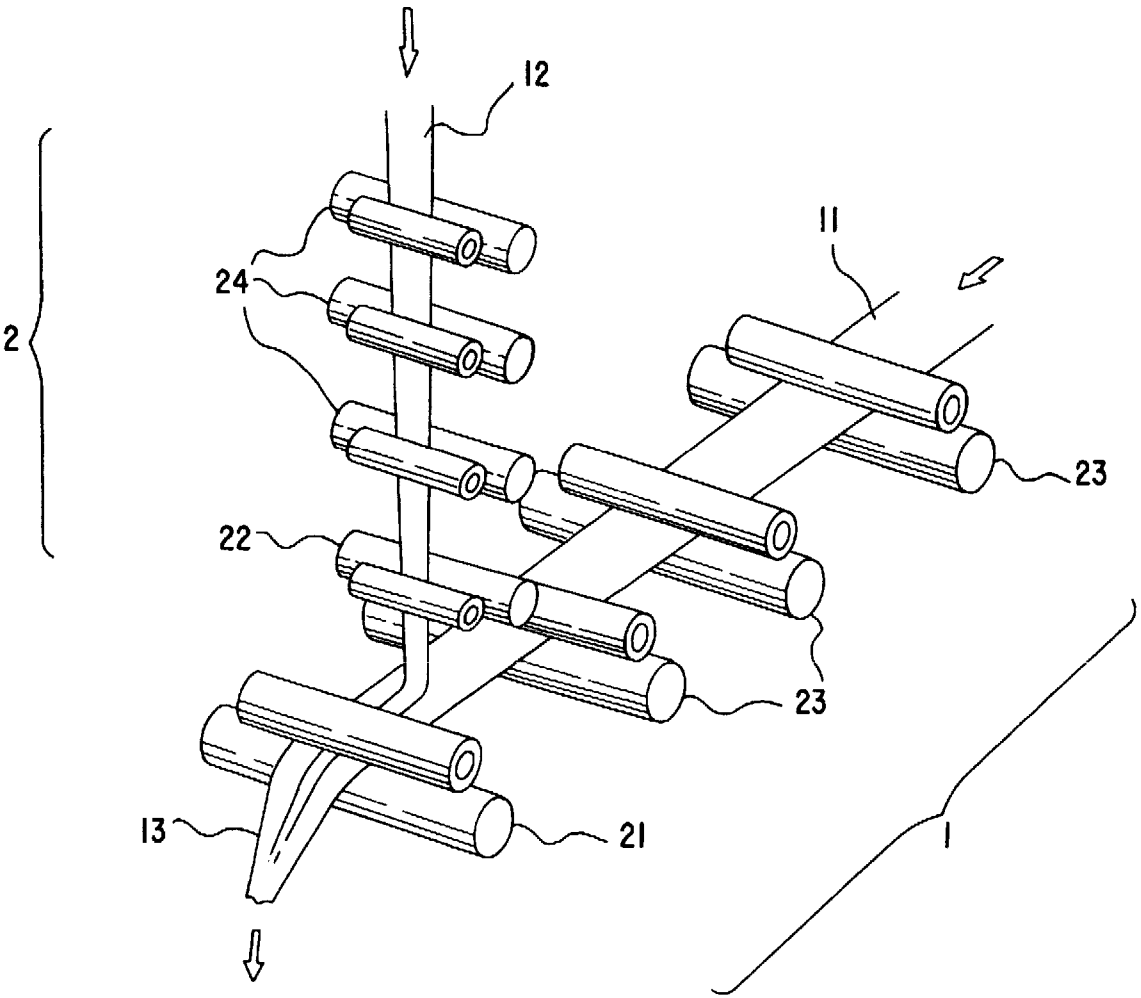
FIG. 1 is an overview of the drafting units of a drawing frame.
Figure 2:
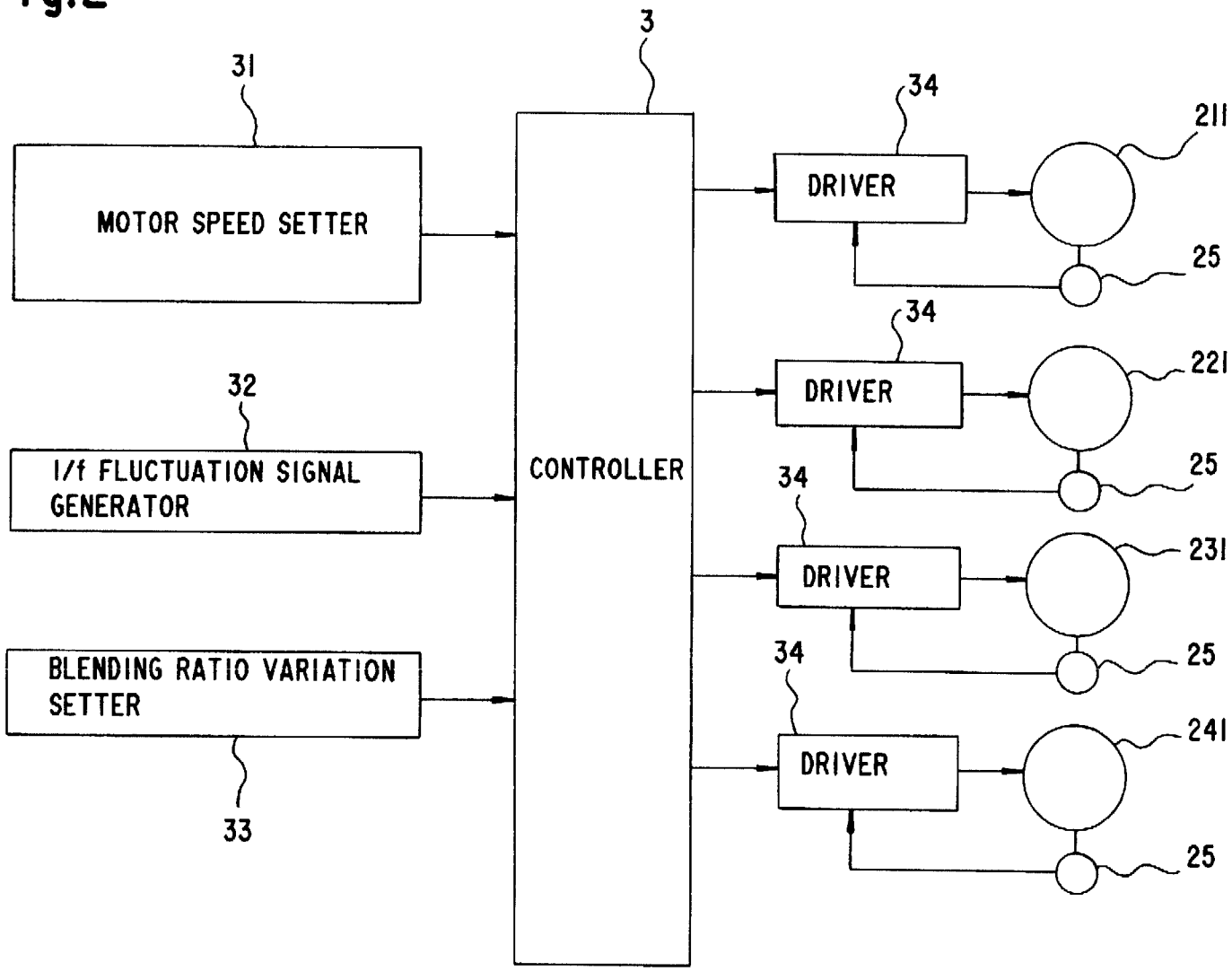
FIG. 2 is a block diagram of the drive motors of a drawing frame.

The drafting units of a drawing frame to produce blended yarn is illustrated in FIG. 1. Different types of fiber slivers are drafted separately using the base sliver drafting unit 1 and the sliver blending drafting unit 2, then combined to form blended slivers 13. The base sliver drafting unit 1 drafts the base slivers 11 by means of the base feed rollers 23 and the base front roller 21. Similarly, the sliver blending drafting unit 2 drafts the blending slivers 12 by means of the blending feed rollers 24 and the blending front roller 22. The blending slivers 12 so drafted are mixed with the base slivers 11 at the base front roller 21, and output as blended slivers 13.

The frame is also equipped with a base front motor 211, blending front motor 221, base feed motor 231, and blending feed motor 241 to control the base front roller 21, blending front roller 22, base feed rollers 23, and blending feed rollers 24 respectively. These motors are controlled in turn by the controller 3, wherein the speed of each motor is set by the motor (base feed, base front, blending feed, and blending front motors) speed setter 31, the 1/f fluctuation signal generator 32, and the blending ratio variation setter 33. Each motor is rotated in accordance with the set values thereof, with the speed being controlled precisely by feedback of the drivers 34 through the speed detectors 25.

Blended spinning can also be accomplished by a similar mechanism using a roving frame or a spinning frame.

2. 1/f fluctuation signals 1/f fluctuation signals are derived from a numerical sequence $Y_1, Y_2, Y_3, \ldots$ formed by multiplying n coefficients, $a_1, a_2, a_3, \ldots, a_n$, on a random sequence of numbers, $X_1, X_2, X_3, \ldots$ Generally, $Y_j$ can be expressed by Equation 1. Here, the sequence of numerical values forming y1, y2, y3, . . . has a 1/f spectrum. (For further details, refer to 'Biological Signaling', Chapter 10, in "Biological Rhythms and Fluctuations", published by Corona Publishers, Ltd.)

$$y_j = x_j + \left(\frac{1}{2}\right) x_{j-1} + \left(\frac{1*3}{2^2*2!}\right) x_{j-2} + \left(\frac{1*3*5}{2^3*3!}\right) x_{j-3} + \cdots \left(\frac{1*3*5*\ldots*(2n-1)}{2^{n-1}*(n-1)!}\right) x_{j-n+1} \quad (1)$$

In Equation 1, x is virtually any arbitrary random number; and n represents the Nth term which determines the lower limit of the frequency range of the 1/f spectrum.

3. 1/f fluctuation signal generator

A sequence of numerical values having a 1/f fluctuation is obtained in two steps using the 1/f fluctuation signal generator 32. In step 1, a computer, for example, generates a sequence of random numbers, x. In step 2, a certain number, n, of coefficients, a, stored in a storage device, are successively multiplied on the random numbers, and then a sequence of numerical values, y, is obtained by a linear transformation. This numerical sequence, y, has a 1/f spectrum, and can be used as a sequence of numerical values having a 1/f fluctuation. An example of a numerical sequence with a 1/f fluctuation so obtained is shown below in Numerical Sequence (2). Other numerical sequences with a 1/f fluctuation can be derived, for example, from a sound, melody, or a breath of wind, the strengths of which varies with a 1/f fluctuation.

Numerical Sequence={17, 12, 15, 15, 12, 14, 12, 8, 11, 12, 9, 9, 11, 7, 5, 2, 3, 0, 6, 7, 7, 8, 6, 3, 3, 6, 6, 3, 2, 4, 24, 2, 0, 5, 6, 7, 7, 5, 7, 9, 4, 1, 4, 8, 7, 5, 4, 6, 2, 0, 6, 3, 7, 8, 10, 10, 5, 5, 8, 9, 7, 11, 5, 7, 8, 10, 6, 10, 9, 10, 10, 8, 11, 13, 10, 8, 6, 7, 4, 9, 7, 8, 7, 8, 3, 5, 7, 10, 11, 8, 5, 7, 6, 3, 8, 11, 10, 12, 9, 6, 11, 12, 13, 11, 10, 6, 6, 9, 7, 6, 2, 7, 9, 4, 1, 6, 8, 11, 9, 12, 12, 11, 7, 11, 6, 3, 5, 6, 9, 11, 6, 10, 6, 5, 3, 4, 9, 7, 7, 3, 4, 5, 3, 1, 1, 2, 6, 8, 11, 8, 11, 14, 14, 10, 9, 8, 7, 7, 8, 10, 5, 6, 7, 3, 5, 7, 10, 7, 9, 11, 12, 11, 9, 10, 12, 15, 12, 11, 13, 13, 13, 15, 16, 18, 20, 17, 17, 12, 13, 16, 12, 15, 11, 12, 16, 15, 12, 14, 13, . . . }

Next, a blending spinning method in which the blending ratio of the different types of fibers will have a correlation of a 1/f fluctuation will be explained.

5. Settings of drawing frame

First, the weight per unit length for the blended slivers to be manufactured 13, and a reference value "a" for the blending ratio of the base slivers 11 and the blending slivers 12 being fed are determined, and a 1/f fluctuation "b" is imparted to the reference value "a". For example, as shown in FIG. 3, the reference value "a" is set at 50%, for a blending of equal parts of base slivers 11 and blending slivers 12.

Accordingly, the speed of each motor is set in the motor speed setter 31 as a function of the weight per unit length of the base slivers 11 and blending slivers 12 being fed, and from the reference value "a" for the blending ratio. Then a numerical sequence with a 1/f fluctuation is set in the motor speed setter 31, and a degree of variation "c" having a 1/f fluctuation for the blending ratio is set in the blending ratio variation setter 33. For example, a variation of ±20% for a reference value of 50% is set; that is, the degree of variation "c" is set between 30% and 70%.

The relationship between the blending ratio and the position along with fiber bundle is shown in FIG. 3.

6. Imparting a 1/f fluctuation to blended slivers

1/f fluctuation signals are applied to the base feed motor 231, then as the base feed rollers 23 rotate, the base slivers 11 are drawing-in at a speed having 1/f fluctuation signals and drafted at the base slivers drafting unit 1, wherein slivers having 1/f fluctuation signals are output from the base front roller 21.

Meanwhile, 1/f fluctuation signals of reverse phase to those signals applied to the base feed motor 231 are applied to the blending feed motor 241; then as the blending feed rollers 24 rotate, the blending slivers 12 are drawing-in at a speed having 1/f fluctuation signals of reverse phase to that of the base slivers 11 and drafted by the sliver blending drafting unit 2, and blending slivers having 1/f fluctuations signals of reverse phase to that of the base slivers 11 are output form the blending front roller 22.

Drafting unit 1 and drafting unit 2 are operated together in this manner to produce blended slivers 13 in which the proportion of "d" of each type of fiber varies in accordance with the 1/f fluctuation signals. Moreover, the blended slivers 13 which have passed through the drafting unit 1 and drafting unit 2 have 1/f fluctuation signals of mutually reverse phase to ultimately produce blended sliver 13 of a constant weight per unit length. The blending ratio of these slivers is shown in FIG. 4.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A blended yarn spinning frame for spinning a number of different fibers comprising:

a blending ratio variation setter;

a 1/f fluctuation signal generator;

a motor speed setter;

a controller operationally attached to the blending ratio setter, the 1/f fluctuation setter and the motor speed setter;

a first drafting unit operationally connected to the controller; and a second drafting unit operationally connected to the controller;

said first drafting unit including a base front roller, a base feed roller, a base front driver, a base feed driver, a first speed detector operationally attached to the base front roller and the base front driver, and a second speed detector operationally attached to the base feed roller and the base feed driver.

2. A blended yarn spinning frame for spinning a number of different fibers comprising:

a blending ratio variation setter;

a 1/f fluctuation signal generator;

a motor speed setter;

a controller operationally attached to the blending ratio setter, the 1/f fluctuation setter and the motor speed setter;

a first drafting unit operationally connected to the controller; and a second drafting unit operationally connected to the controller;

said second drafting unit including a blending feed roller, a blending front roller, a blending front driver, a blending feed driver, a first speed detector operationally attached to the blending front roller and the blending front driver, and a second speed detector operationally attached to the blending feed roller and the blending feed driver.

* * * * *

UNITED STATES PATENT AND TRADEMARK OFFICE

CERTIFICATE OF CORRECTION

PATENT NO. : 5,752,295

DATED : May 19, 1998

INVENTOR(S) : MUSHA et al.

It is certified that error appears in the above-identified patent and that said Letters Patent is hereby corrected as shown below:

Item [54], line 1, please delete "1 F" insert therefor --

1/f --

Signed and Sealed this

Twenty-first Day of July, 1998

*Attest:*

*Attesting Officer*

BRUCE LEHMAN

*Commissioner of Patents and Trademarks*